US007594537B2

(12) United States Patent
Hou et al.

(10) Patent No.: US 7,594,537 B2
(45) **Date of Patent: *Sep. 29, 2009**

(54) HEAT PIPE WITH CAPILLARY WICK

(75) Inventors: Chuen-Shu Hou, Tu-Cheng (TW); Tay-Jian Liu, Tu-Cheng (TW); Chao-Nien Tung, Tu-Cheng (TW); Chih-Hsien Sun, Tu-Cheng (TW)

(73) Assignee: Foxconn Technology Co., Ltd., Tu-Cheng, Taipei Hsien (TW)

( * ) Notice: Subject to any disclaimer, the term of this patent is extended or adjusted under 35 U.S.C. 154(b) by 89 days.

This patent is subject to a terminal disclaimer.

(21) Appl. No.: 11/309,246

(22) Filed: Jul. 19, 2006

(65) Prior Publication Data

US 2007/0193723 A1 Aug. 23, 2007

(30) Foreign Application Priority Data

Feb. 17, 2006 (CN) ..... 2006 1 0033802

(51) Int. Cl.
*F28D 15/04* (2006.01)

(52) U.S. Cl. ..... 165/104.26; 165/146

(58) Field of Classification Search ..... 165/104.26, 165/146, 147
See application file for complete search history.

(56) References Cited

U.S. PATENT DOCUMENTS

| | | | | |
|---|---|---|---|---|
| 3,754,594 | A | 8/1973 | Ferrell | |
| 4,489,777 | A * | 12/1984 | Del Bagno et al. | 165/104.26 |
| 5,010,951 | A * | 4/1991 | Kapolnek et al. | 165/104.26 |
| 6,997,243 | B2 * | 2/2006 | Hsu | 165/104.26 |
| 6,997,244 | B2 * | 2/2006 | Hul-Chun | 165/104.26 |
| 7,134,485 | B2 * | 11/2006 | Hul-Chun | 165/104.26 |
| 2003/0141045 | A1 * | 7/2003 | Oh et al. | 165/104.26 |

FOREIGN PATENT DOCUMENTS

| | | | |
|---|---|---|---|
| CN | 2613740 | Y | 4/2004 |
| CN | 2735283 | Y | 10/2005 |
| JP | 58-35388 | A | 3/1983 |

* cited by examiner

*Primary Examiner*—Leonard R Leo
(74) *Attorney, Agent, or Firm*—Frank R. Niranjan

(57) ABSTRACT

A heat pipe includes a casing (100) containing a working fluid therein and a capillary wick (200) arranged on an inner wall of the casing. The casing includes an evaporating section (400) at one end thereof and a condensing section (600) at an opposite end thereof, and a central section (500) located between the evaporating section and the condensing section. The thickness of the capillary wick formed at the evaporating section is smaller than that of the capillary wick formed at the central section in a radial direction of the casing. The capillary wick is capable of reducing thermal resistance between the working fluid and the casing.

15 Claims, 5 Drawing Sheets

HEAT PIPE WITH CAPILLARY WICK

FIELD OF THE INVENTION

The present invention relates generally to apparatuses for transfer or dissipation of heat from heat-generating components such as electronic components, and more particularly to a heat pipe having a capillary wick with graduated thickness.

DESCRIPTION OF RELATED ART

Heat pipes have excellent heat transfer properties, and therefore are an effective means for the transference or dissipation of heat from heat sources. Currently, heat pipes are widely used for removing heat from heat-generating components such as the central processing units (CPUs) of computers. A heat pipe is usually a vacuum casing containing a working fluid therein, which is employed to carry thermal energy from one section of the heat pipe (typically referred to as an evaporating section) to another section thereof (typically referred to as a condensing section) under phase transitions between a liquid state and a vapor state. Preferably, a wick structure is provided inside the heat pipe, lining an inner wall of the casing, drawing the working fluid back to the evaporating section after it is condensed in the condensing section. Specifically, as the evaporating section of the heat pipe is maintained in thermal contact with a heat-generating component, the working fluid contained at the evaporating section absorbs heat generated by the heat-generating component and then turns into vapor. The generated vapor flows towards the condensing section under the influence of the difference of vapor pressure between the two sections of the heat pipe. The vapor is then condensed into liquid after releasing the heat into ambient environment, for example by fins thermally contacting the condensing section, where the heat is then dispersed. Due to the difference in capillary pressure developed by the wick structure between the two sections, the condensed liquid can then be drawn back by the wick structure to the evaporating section where it is again available for evaporation.

FIG. 5 shows an example of a heat pipe in accordance with related art. The heat pipe includes a metal casing 10 and a single layer capillary wick 20 of uniform thickness attached to an inner surface of the casing 10. The casing 10 includes an evaporating section 40 at one end and a condensing section 60 at the other end. An adiabatic section 50 is provided between the evaporating and condensing sections 40, 60. The generated vapor flows from the evaporating section 40 through the adiabatic section 50 to the condensing section 60. The thickness of the capillary wick 20 is uniformly arranged against the inner surface of the casing 10 from its evaporating section 40 to its condensing section 60. However, this singular and uniform-type wick 20 generally cannot provide optimal heat transfer for the heat pipe because it cannot simultaneously produce a large capillary force and a low thermal resistance. The evaporating and condensing sections 40, 60 of the heat pipe have different demands due to their different functions. The thermal resistance between the working fluid and the condensing section 60 of the heat pipe increases due to the uniform thickness of the capillary wick 20. The increased thermal resistance significantly reduces the heat-dissipating speed of the working fluid in the condensing section 60 of the heat pipe to ambient environment and ultimately limits the heat transfer performance of the heat pipe.

Therefore, it is desirable to provide a heat pipe with wick of graduated thickness that can provide a satisfactory rate of heat dissipation for the working fluid in the condensing section of the heat pipe and a reduced thermal resistance to the condensed liquid.

SUMMARY OF THE INVENTION

A heat pipe in accordance with a preferred embodiment of the present invention includes a casing containing a working fluid therein and a capillary wick arranged on an inner wall of the casing. The casing includes an evaporating section at one end thereof and a condensing section at an opposite end thereof, and a central section located between the evaporating section and the condensing section. The capillary wick formed at the evaporating section is thinner than the capillary wick formed at the central section. The capillary wick is capable of reducing thermal resistance between the working fluid and the casing.

Other advantages and novel features of the present invention will become more apparent from the following detailed description of preferred embodiment when taken in conjunction with the accompanying drawings, in which:

BRIEF DESCRIPTION OF THE DRAWINGS

Many aspects of the present apparatus and method can be better understood with reference to the following drawings. The components in the drawings are not necessarily drawn to scale, the emphasis instead being placed upon clearly illustrating the principles of the present apparatus and method. Moreover, in the drawings, like reference numerals designate corresponding parts throughout the several views.

DETAILED DESCRIPTION OF THE INVENTION

Figure 1:
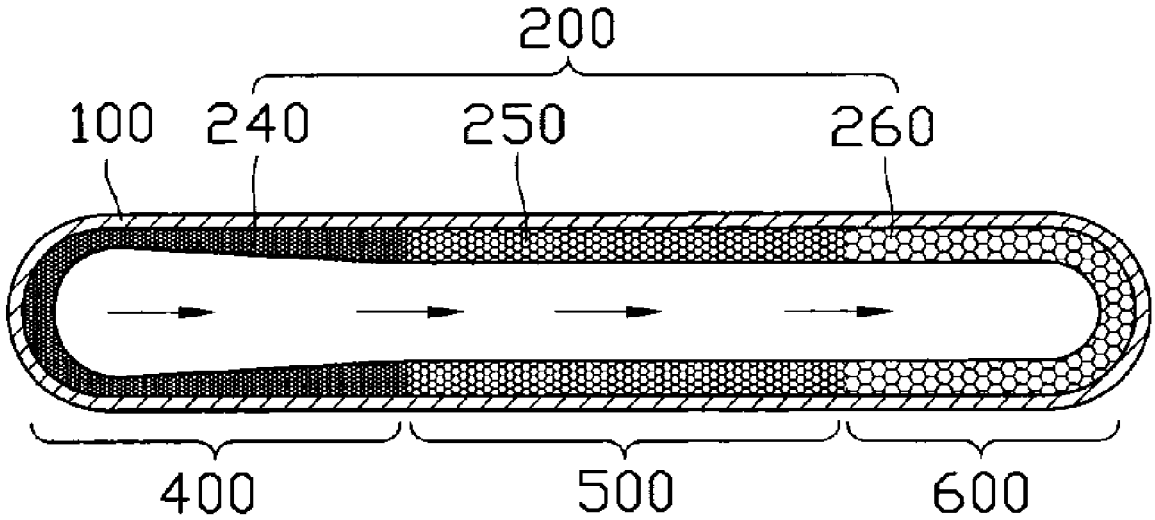
FIG. 1 is a longitudinal cross-sectional view of a heat pipe in accordance with a first embodiment of the present invention.

FIG. 1 illustrates a heat pipe in accordance with a first embodiment of the present invention. The heat pipe comprises a casing 100 and a capillary wick 200 arranged to attach on an inner surface of the casing 100. The casing 100 comprises an evaporating section 400 and a condensing section 600 at an opposite end thereof, and a central section (i.e., adiabatic section) 500 located between the evaporating section 400 and the condensing section 600. The casing 100 is made of highly thermally conductive materials such as copper or copper alloys and filled with a working fluid (not shown), which acts as a heat carrier for carrying thermal energy from the evaporating section 400 to the condensing section 600. Heat that needs to be dissipated is transferred firstly to the evaporating section 400 of the casing 100 to cause the working fluid to evaporate. Then, the heat is carried by the working fluid in the form of vapor to the condensing section 600 where the heat is released to ambient environment, thus condensing the vapor into liquid. The condensed liquid is then brought back via the capillary wick 200 to the evaporating section 400 where it is again available for evaporation.

The capillary wick 200 can be a groove-type wick, a sintered-type wick or a meshed-type wick. Pore sizes of the capillary wick 200 gradually increase from the evaporating section 400 to the condensing section 600 of the casing 100. The capillary wick 200 comprises a first capillary wick 240 formed at the evaporating section 400 of the casing 100, a second capillary wick 250 formed at the central section 500 of the casing 100 and a third capillary wick 260 formed at the condensing section 600 of the casing 100. A thickness of the first capillary wick 240 gradually increases towards the condensing section 600 along a lengthwise direction of the casing 100. The first capillary wick 240 has a graduated thickness along a radial direction of the casing 100. The thickness of the first capillary wick 240 is arranged so that the working fluid may be evaporated rapidly through heat absorption. The thicknesses of the second and third capillary wick 250, 260 in the radial direction of the casing 100 are equal, and equal to the thickest point of the first capillary wick 240 in the radial direction of the casing 100, which is located at an end edge of the first capillary wick 240 immediately adjacent to the second capillary wick 250.

Figure 2:
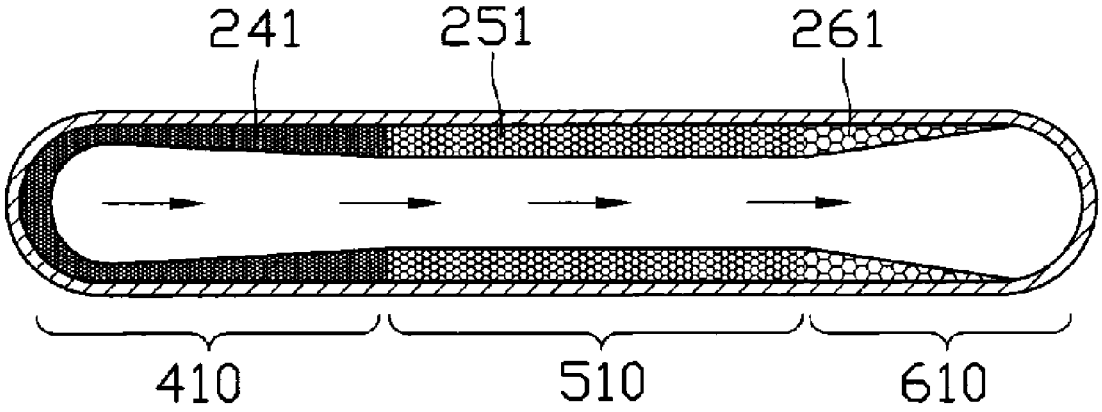
FIG. 2 is a longitudinal cross-sectional view of a heat pipe in accordance with a second embodiment of the present invention.

FIG. 2 illustrates a heat pipe in accordance with a second embodiment of the present invention. The heat pipe comprises an evaporating section 410 at an end thereof, a condensing section 610 at an opposite end thereof, and a central section 510 located between the evaporating section 410 and the condensing section 610. First, second and third capillary wicks 241, 251 and 261 are formed at the evaporating, central and condensing sections 410, 510 and 610 respectively. The third capillary wick 261 is designed to have a changeable section in a radial direction of the heat pipe on the base of the first embodiment of the present invention. The third capillary wick 261 gradually decreases in thickness towards an end of the condensing section 610 remote from the evaporating section 410 in a lengthwise direction of the heat pipe. The closer the third capillary wick 261 is to the end of the heat pipe at the condensing section 610, the thinner the third capillary wick 261 is and even no the third capillary wick 261 is arranged in the end of the heat pipe at the condensing section 610 so as to reduce thermal resistance between the inner wall of the heat pipe at the condensing section 610 and the vaporous working fluid. An average thickness of the third capillary wick 261 at the condensing section 610 is thinner than that of the first capillary wick 241 in the evaporating section 410. The thickness of the thickest point of the first capillary wick 241 at the evaporating section 410 and the third capillary wick 261 at the condensing section 610 is the same and is also equal to the thickness of the second capillary wick 251 formed at the central section 510.

Figure 3:
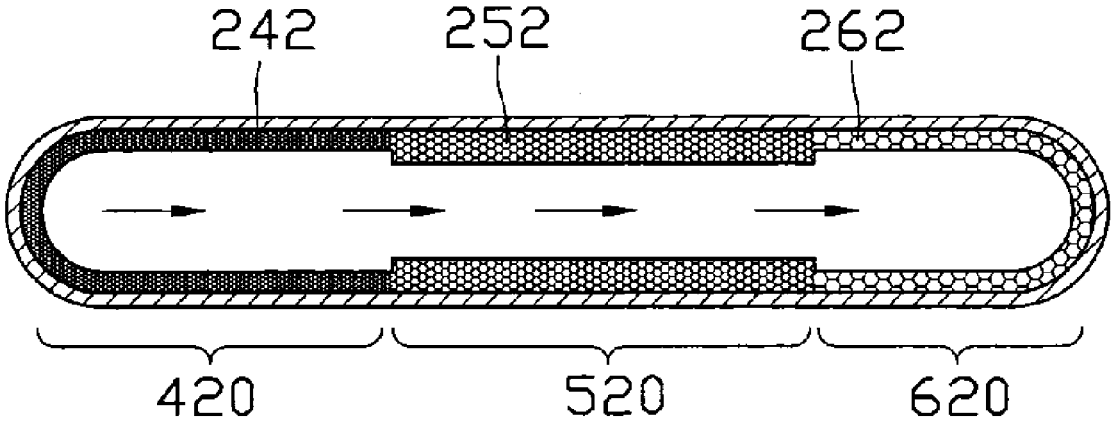
FIG. 3 is a longitudinal cross-sectional view of a heat pipe in accordance with a third embodiment of the present invention.

FIG. 3 illustrates a heat pipe in accordance with a third embodiment of the present invention. The heat pipe comprises an evaporating section 420 at one end thereof, a condensing section 620 at an opposite end thereof, and a central section 520 located between the evaporating section 420 and the condensing section 620. First, second and third capillary wicks 242, 252 and 262 are formed at the evaporating, central and condensing sections 420, 520 and 620 respectively. Main differences between the second and third embodiments are that the thickness of the first capillary wick 242 at the evaporating section 420 and the third capillary wick 262 at the condensing section 620 are uniform. Each of the first and second capillary wicks 242 and 262 has a difference in thickness compared to the second capillary wick 252 formed at the central section 520.

Figure 4:
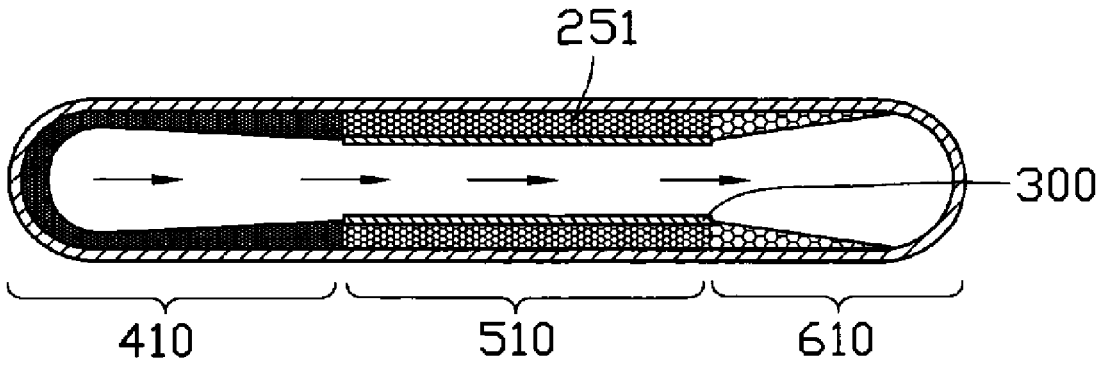
FIG. 4 is a longitudinal cross-sectional view of a heat pipe in accordance with a fourth embodiment of the present invention.
Figure 5:
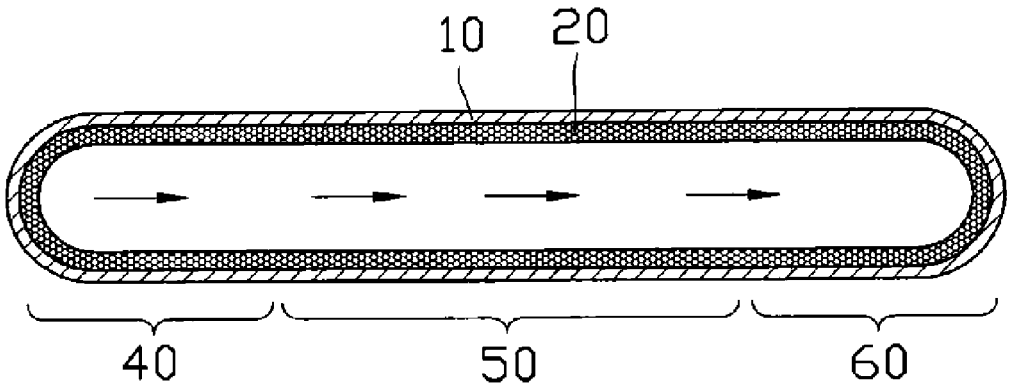
FIG. 5 (RELATED ART)
FIG. 5 is a longitudinal cross-sectional view of a heat pipe in accordance with related art.

FIG. 4 illustrates a heat pipe in accordance with a fourth embodiment of the present invention. A thin tube 300 is disposed in the central section 510 of the heat pipe on the base of the second embodiment of the present invention to separate the evaporated working fluid from the liquid working fluid. An entrainment limit caused by contra-flow between the different ends of the heat pipe can therefore be avoided. Heat transfer performance of the heat pipe is improved. The tube 300 is attached on an inner surface of the second capillary wick 251 at the central section 510. The tube 300 is of a thin film, meshed, metallic or nonmetallic material. The tube 300 can extend towards the evaporating and condensing sections 410, 610 in a proper range. A shape of a section of the tube 300 can be round, ellipsoid or polygonal when a section of a casing (not labeled) of the heat pipe is round, ellipsoid or polygonal.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A heat pipe comprising:

a metal casing containing a working fluid therein, the casing comprising an evaporating section and a condensing section at an opposite end thereof, and a central section located between the evaporating section and the condensing section; and a capillary wick arranged on an inner surface of the casing; wherein a thickness of the capillary wick formed at the evaporating section in a radial direction of the casing is smaller than that of the capillary wick formed in the central section of the casing;

wherein an average thickness of the capillary wick at the condensing section is smaller than that of the capillary wick at the evaporating section.

2. The heat pipe of claim 1, wherein pore sizes of the capillary wick gradually increase from the evaporating section to the condensing section of the casing.

3. The heat pipe of claim 1, wherein the thickness of the capillary wick formed at the evaporating section gradually increases towards the condensing section in a lengthwise direction of the casing.

4. The heat pipe of claim 3, wherein the thickness of the capillary wick formed at the condensing section gradually decreases towards an end of the condensing section remote from the evaporating section in a lengthwise direction of the casing.

5. The heat pipe of claim 4, wherein the casing further comprises a tube attached to an inner surface of the capillary wick in the central section of the casing.

6. The heat pipe of claim 1, wherein an average thickness of the capillary wick formed at the condensing section is smaller than that of the capillary wick formed at the central section.

7. The heat pipe of claim 6, wherein the capillary wick is a grooved-type wick.

8. The heat pipe of claim 6, wherein the capillary wick is a sintered-type wick.

9. A heat pipe for transmitting heat from one section of the heat pipe to another section of the heat pipe comprising:

a metal hollow casing containing a working fluid therein, the casing comprising an evaporating section, a condensing section and a central section between the evaporating section and condensing section; and a capillary wick formed at an inner wall of the casing, the capillary wick comprising a first capillary wick formed at the evaporating section of the casing, a second capillary wick formed at the central section of the casing and a third capillary wick formed at the condensing section of the casing, wherein a thickness of the first capillary wick is smaller than that of the second capillary wick;

wherein a thickness of the third capillary wick gradually decreases towards an end of the condensing section remote from the evaporating section in a lengthwise direction of the casing; and wherein an average thickness of the third capillary wick is smaller than that of the first capillary wick.

10. The heat pipe of claim 9, wherein the thickness of the first capillary wick gradually increases towards the condensing section in a lengthwise direction of the casing.

11. The heat pipe of claim 10, wherein the casing further comprises a tube attached to an inner surface of the capillary wick in the central section of the casing.

12. A heat pipe comprising:

a casing having an evaporating section, a condensing section and a central section between the evaporating and condensing sections;

a working fluid received in the casing, the working fluid receiving heat at the evaporating section to become vapor, the vapor condensing into liquid at the condensing section; and a capillary wick attached to an inner wall of the casing, wherein the capillary wick has a pore size gradually increased from the evaporating section to the condensing section and the capillary wick at the evaporating section has a thickness which is smaller than that of the capillary wick at the central section;

wherein an average thickness of the capillary wick at the condensing section is smaller than that of the capillary wick at the evaporating section.

13. The heat pipe of claim 12, wherein the thickness of the capillary wick at the evaporating section is gradually increased along a direction from the evaporating section toward the condensing section.

14. The heat pipe of claim 13, wherein the capillary wick at the condensing section has a thickness gradually decreased toward an end of the condensing section remote from the evaporating section.

15. The heat pipe of claim 14, wherein a tube is attached to an inner surface of the capillary wick at the central section.

* * * * *

UNITED STATES PATENT AND TRADEMARK OFFICE

CERTIFICATE OF CORRECTION

PATENT NO. : 7,594,537 B2
APPLICATION NO. : 11/309246
DATED : September 29, 2009
INVENTOR(S) : Hou et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 161 days.

Signed and Sealed this

Twenty-eighth Day of September, 2010

David J. Kappos

David J. Kappos
*Director of the United States Patent and Trademark Office*